United States Patent [19]

Raskov

[11] Patent Number: 4,553,025

[45] **Date of Patent: * Nov. 12, 1985**

[54] INSULATED ELECTRIC HEATING ELEMENT

[76] Inventor: Herman E. Raskov, 6312 Seward Park Ave. S., Seattle, Wash. 98118

[ * ] Notice: The portion of the term of this patent subsequent to Oct. 30, 2001 has been disclaimed.

[21] Appl. No.: 657,345

[22] Filed: Oct. 3, 1984

Related U.S. Application Data

[63] Continuation-in-part of Ser. No. 401,640, Jul. 26, 1982, Pat. No. 4,480,176.

[51] Int. Cl.[4] ..... H05B 3/68

[52] U.S. Cl. ..... 219/461; 174/138 J; 219/347; 219/455; 219/460; 219/467; 219/532; 219/536; 219/550; 219/552; 338/242

[58] Field of Search ..... 219/345, 347, 354, 355, 219/455, 460, 461, 462, 463, 467, 532, 536, 550, 552; 174/138 J; 338/238, 242

[56] References Cited

U.S. PATENT DOCUMENTS

| | | | |
|---|---|---|---|
| 1,049,488 | 1/1913 | Hughes et al. | 219/460 X |
| 1,472,201 | 10/1923 | Woodson | 219/461 |
| 1,819,537 | 8/1931 | Berry | 219/550 |
| 2,022,466 | 11/1935 | Hess | 219/550 |
| 2,091,905 | 8/1937 | Bensel et al. | 219/461 |
| 2,658,984 | 11/1953 | Mohn | 219/354 |
| 2,662,158 | 12/1953 | Vallorani et al. | 219/455 |
| 2,747,070 | 5/1956 | Bargehr | 219/550 X |
| 2,822,456 | 2/1958 | Glynn | 219/345 |
| 2,836,698 | 5/1958 | Fry | 219/461 |
| 2,907,873 | 10/1959 | Smith | 219/347 |
| 2,963,539 | 12/1960 | Hynes | 174/138 J |
| 3,052,789 | 9/1962 | Trainor | 219/347 |
| 3,086,101 | 4/1963 | Scofield | 219/460 |
| 3,322,946 | 5/1967 | Cooper | 219/347 |
| 3,358,074 | 12/1967 | Himes | 174/138 J |
| 3,363,090 | 1/1968 | Langley | 219/540 |
| 3,471,680 | 10/1969 | Kelm | 219/342 |
| 3,471,682 | 10/1969 | Hisey et al. | 219/388 |
| 3,668,303 | 6/1972 | Alexander | 174/138 J |
| 4,115,918 | 9/1978 | Anderl et al. | 29/611 |
| 4,311,899 | 1/1982 | Goessler | 219/461 |
| 4,480,176 | 10/1984 | Raskov | 219/461 |

FOREIGN PATENT DOCUMENTS

| | | | |
|---|---|---|---|
| 929803 | 7/1955 | Fed. Rep. of Germany | 219/461 |

*Primary Examiner*—Volodymyr Y. Mayewsky
*Attorney, Agent, or Firm*—Christensen, O'Connor, Johnson & Kindness

[57] ABSTRACT

An insulated electric heating element particularly suitable for use in a hot plate or electric stove is disclosed. The insulated electric heating element (11) includes a unitary two chamber housing (21). The chambers are located one above the other. A U-shaped upper chamber (22) houses a resistive electric heating element (23). A U-shaped lower chamber (24) houses thermal insulation (30). The thermal insulation reduces the heat radiated downwardly and sidewardly and correspondingly increases the heat radiation upwardly by the electric heating element.

2 Claims, 2 Drawing Figures

INSULATED ELECTRIC HEATING ELEMENT

This application is a continuation-in-part of U.S. application Ser. No. 401,640, filed July 26, 1982, and entitled Insulated Electric Heating Element now U.S. Pat. No. 4,480,176. The disclosure of parent application Ser. No. 401,640 is hereby incorporated reference.

TECHNICAL AREA

This invention relates to electric heating elements and, more particularly, electric heating elements usable in hot plates, stoves, etc.

BACKGROUND OF THE INVENTION

Electric heating elements of the type widely used in electric hot plates and stoves include a resistive heating element enclosed by a shell-like housing. The housing is supported by several arms that in turn are supported by a saucer or cup designated to catch debris running down the side of a vessel being heated. Such debris catchers are designed to be easily removed for cleaning.

During heating, the vessel to be heated is placed atop the horizontally arrayed heating element housing. Electric power applied to the resistive heating element heats the vessel lying atop the heating element housing. The purpose of the heating element is to heat the vessel lying on the top of the heating element housing by radiating heat upwardly toward the vessel. With prior art electric heating elements, heat is also radiated downwardly and sidewardly. While some of the downward and sideward radiated heat ultimately assists in heating the vessel (because heat flows upwardly), some of the downward and sideward radiated heat is lost. For example, part of the heat is lost by the debris collecting cup or saucer (which is usually formed of metal) being heated and conducting part of the heat energy received away from the area underlying the vessel being heated. This invention is directed to avoiding this and other heat losses due to heat radiation away from the vessel to be heated.

SUMMARY OF THE INVENTION

In accordance with this invention, an insulated electric heating element is provided. The insulated electric heating element includes a unitary, two chamber housing. The chambers are located one above the other. The upper chamber houses a resistive electric heating element and the lower chamber houses thermal insulation, preferably a ceramic insulation. More specifically, the lower chamber is U-shaped in cross section and the insulation is housed within the lower chamber, filling the entire bottom portion of the U-shaped lower chamber and extending up the sides of the chamber. The legs of the U-shaped lower chamber unitarily join the longitudinal edges of the top of the upper heating element chamber. More specifically, the top of the upper heating element chamber, which receives vessels to be heated, is flat. The bottom of the upper or resistive electric heating element chamber is configured to create a chamber suitable for housing a resistive electric heating element. Preferably, the bottom of the upper heating element chamber has a U-shaped cross-sectional configuration. In any event, the legs of the U-shaped lower chamber terminate at the edge of the flat top of the upper chamber. The lower chamber insulation reduces heat radiation downwardly and sidewardly and, correspondingly, increases heat radiation upwardly.

As will be readily appeciated from the foregoing description, the invention provides an insulated electric heating element. Because downward and sideward heat radiation is substantially reduced, the amount of heat radiated upwardly and, thus, directly applied to the vessel to be heated, is increased. The end result is that the vessel and its contents are heated to a desired temperature for a lower electrical energy cost.

BRIEF DESCRIPTION OF THE DRAWINGS

The foregoing aspects and many of the attendant advantages of this invention will become more readily appreciated as the same becomes better understood by reference to the following detailed description when taken in conjunction with the accompanying drawings wherein.

DESCRIPTION OF THE PREFERRED EMBODIMENT

Figure 1:
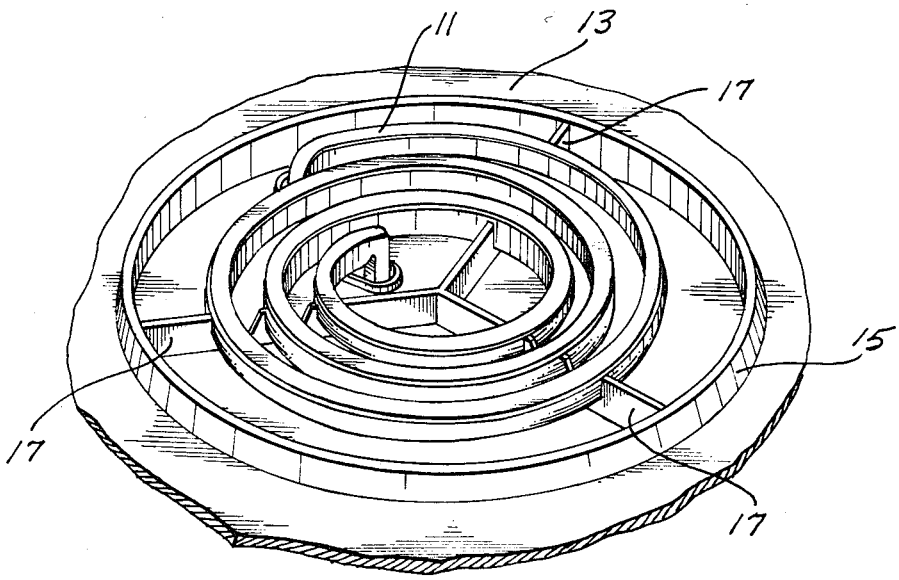
FIG. 1 is a pictorial view of an insulated electric heating element formed in accordance with the invention; and, FIG. 2 is a cross-sectional, partial perspective view of the insulated electric heating element illustrated in FIG. 1.
Figure 2:
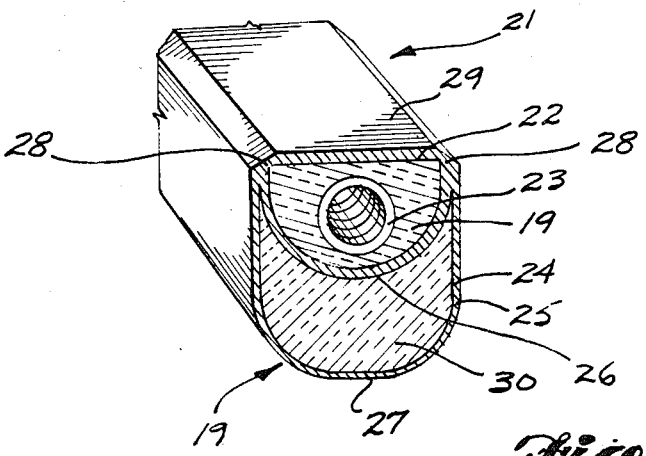

FIG. 1 illustrates a spirally shaped, elongate electric heating element 11 formed in accordance with the invention and mounted atop a hot plate or stove 13. More specifically, the hot plate or stove 13 supports a cup or saucer shaped debris catcher 15 in a suitably sized round hole formed in the hot plate or stove 13. The debris catcher 15 supports three radial support arms 17. One or more of the support arms 17 have notched upper edges. The spiral heating element 11 lies in the notches. The spiral heating element includes a shell-like unitary housing 21 having an upper chamber 22 and a lower chamber 24 (FIG. 2). The upper chamber houses a resistive electric heating element 23 surrounded by an electrically insulating, thermally conducting insulation 19, such as magnesium oxide.

The shape of the upper or resistive electric heating element chamber 22 is defined by a flat top 29 and a U-shaped bottom 26 that extends between the opposing longitudinal edges 28 of top 22. The top of the lower chamber 24 is defined by the bottom 26 of the upper chamber 22 and the bottom of the lower chamber is defined by the bottom 27 of the overall housing 21. The bottom 27 of the lower chamber is also U-shaped.

The notches in the support arms 17 are shaped to conform to the bottom 27 of the housing 21 and sized such that the flat top 29 of the heating element lies slightly above the upper edges of the support arms 17. Thus, when a vessel to be heated is positioned atop the heating element, the vessel rests on the heating element housing 21, not on the upper edges of the support arms. Hence, no gap is created between the heating element 11 and the vessel.

When a conventional resistive electric heating element is energized by a suitable source of electrical energy, heat is radiated not only from the top of the heating element housing, but also downwardly and sidewardly from the bottom of the heating element housing. While some of the downward and sideward heat radiation rises and ultimately increases the temperature of the vessel, much of the heat is lost. Some of the lost heat is received by the debris catcher from which it is conducted away from the vessel by the upper surface of the stove. The heat is then radiated by the stove, away from the vessel to be heated. As a result, more electrical energy than desirable is required to heat the vessel (and its contents). This invention is directed to reducing this and similar types of heat loss and, thus, the cost of energy required to heat vessels positioned atop electric heating elements.

As illustrated in FIG. 2, the invention contemplates insulating the lower region of a heating element housing 21 to reduce the amount of heat radiated downwardly and sidewardly when the resistive electric heating element 23 is energized. This is accomplished by filling the lower chamber 24 of the heating element housing 21 with thermal insulation 30. Preferably, the thermal insulation 30 is a ceramic insulation, such as the ceramic fiber insulation sold by Babcock and Wilcox Co., Augusta, Ga., under the trademark KAOWOOL. Due to the shape of the lower chamber 24, the insulation 30 extends at least partially up the sidewalls of the lower chamber and, thus, covers the surface of the bottom 26 of the upper chamber 22.

As will be readily appreciated from the foregoing description, the invention provides an insulated electric heating element designed so that heat radiation from the bottom and sides of the electrical heating element is minimized. This result is achieved by creating an electric heating element housing having two chambers, rather than a single chamber. The chambers are located one atop the other with the upper chamber housing a resistive electric heating element and the lower chamber housing thermal insulation.

While the preferred embodiment of the invention has been illustrated and described, it will be appreciated that various changes can be made therein without departing from the spirit and scope of the invention. Consequently, the invention can be practiced otherwise than as specifically described herein.

The embodiments of the invention in which an exclusive property or privilege is claimed are defined as follows:

1. An insulated, electric heating element suitable for use in an electric heating system designed to emit heat in a predetermined direction comprising:

(a) a heating element housing having an upper chamber and lower chamber, the cross-sectional configuration of the upper chamber including a flat top, the top having opposing longitudinal edges and a generally U-shaped bottom, the cross-sectional configuration of the lower chamber including a generally U-shaped bottom, the legs of the lower chamber bottom unitarily joining the longitudinal edges of the top of the upper chamber, the cross-sectional shape of the top of the lower chamber being defined by the bottom of the upper chamber;

(b) an electric resistive heating element mounted in said upper chamber; and (c) thermal insulation material housed in said lower chamber, said thermal insulation material preventing downward and sideward heat radiation from said heating element housing.

2. The insulated electric heating element of claim 1 wherein said thermal insulation material is a ceramic fiber insulation material.

* * * * *